United States Patent [19]

Nicoloso

[11] Patent Number: 4,700,029

[45] Date of Patent: Oct. 13, 1987

[54] HIGH-TENSION CIRCUIT-BREAKER HAVING ARC-EXTINGUISHING GAS UNDER PRESSURE

[75] Inventor: Dante Nicoloso, Jonage, France

[73] Assignee: Alsthom, Paris, France

[21] Appl. No.: 15,411

[22] Filed: Feb. 17, 1987

[30] Foreign Application Priority Data

Feb. 17, 1986 [FR] France ..... 86 02100

[51] Int. Cl.[4] ..... H01H 33/54

[52] U.S. Cl. ..... 200/148 B; 200/148 R; 200/148 G

[58] Field of Search ..... 200/148 B, 148 R, 148 E, 200/148 G

[56] References Cited

U.S. PATENT DOCUMENTS

| | | | |
|---|---|---|---|
| 4,386,250 | 5/1983 | Nicoloso | 200/148 B |
| 4,609,798 | 9/1986 | Nicoloso | 200/148 B |
| 4,612,428 | 9/1986 | Nicoloso | 200/148 B |

*Primary Examiner*—Robert S. Macon

*Attorney, Agent, or Firm*—Sughrue, Mion, Zinn, Macpeak and Seas

[57] ABSTRACT

A high-tension circuit-breaker having dielectric gas under pressure, the circuit-breaker comprising at least one assembled pair of first and second superposed insulating columns, the first column (3) acting as a support and the second column enclosing a circuit-breaking chamber, each of said columns being provided at its end facing the other column of the pair with a closure plate (5,6) enabling the columns to be disassembled without losing the gas contained in either of them, said plates being provided with respective central holes for passing a rod (12, 13) for operating the circuit-breaker contacts, the circuit-breaker being characterized in that each of said plates (5, 6) includes at least one hollow portion with said hollow portions facing each other in pairs, each of which defines a housing for receiving a container (4) of regenerator material, the end of each hollow portion and the two ends of each container being provided with holes to enable gas to flow from one column to the other through said regenerator material, with the holes through said hollow portions being closed by valve plates (50, 60) located inside the columns and urged by springs towards a closure position when the columns are disassembled, with each of the valve plates including a part (50A, 60A) which, when the columns are assembled and a container is in place, bear against the container in order to hold the valve plate in its open position against the resilient urging of the spring.

4 Claims, 6 Drawing Figures

HIGH-TENSION CIRCUIT-BREAKER HAVING ARC-EXTINGUISHING GAS UNDER PRESSURE

The invention relates to a high-tension circuit-breaker having arc-extinguishing gas under pressure, in which the gas-filled components can be assembled and disassembled without losing gas, the circuit-breaker including a gas-regenerating element which can likewise be replaced without losing gas.

BACKGROUND OF THE INVENTION

High-tension circuit-breakers generally comprise at least two superposed insulating columns which are bolted together, with one of the columns delimiting a circuit-breaking chamber and with the other containing an operating rod. These columns are filled with a dielectric gas under pressure, e.g. sulfur hexafluoride ($SF_6$).

Circuit-breakers of the above-specified type require a gas-regenerating element, since each time the circuit-breaker interrupts a current, the dielectric qualities of the gas deteriorate and this can lead to a dangerous loss of circuit-breaker performance capacity.

French patent application No. 79 29498 filed Nov. 30, 1979 (corresponding to U.S. Pat. No. 4 386 250) describes a circuit-breaker having components which can be assembled and disassembled with little loss of dielectric gas. However, this circuit-breaker does not provide for the inclusion of a regenerator element.

Circuit-breakers are also known which include a regenerator element (a molecular sieve). One such circuit-breaker is shown in accompanying FIG. 1 which is fragmentary diagrammatic axial section through one pole of a puffer $SF_6$ gas circuit-breaker. The pole comprises a circuit-breaking chamber 2 closed at its ends by a plate 2A and by casing 5, together with an insulating support 3 which is closed at its ends by end plates 3A and 6. A molecular sieve 4 is disposed between the casing 5 of the circuit-breaking chamber 2 and the top end plate 6 of the support 3. $SF_6$ gas exchange takes place between the chamber 2 and the support 3 through the molecular sieve 4 via a passage 7 through the casing 5 of the chamber 2, and via a passage 8 through the top end plate 6 of the support 3.

The circuit-breaker is operated by means of an actuator 9 fed from a source of energy that enables a piston 10 to be displaced alternately upwardly and downwardly, said piston 10 being connected to an arc-blasting device 11 in the chamber 2 via an insulating rod 12 and a rod 13 forming a part of the moving contact 21, which rods are connected together by a device 14. The fixed contact is referenced 22. The two enclosures of the chamber 2 and the support 3 are sealed by means of sealing rings 15, 16, 17, 18, 19, and 20. In this type of circuit-breaker, it is impossible to assemble or disassemble the components or to replace the molecular sieve 4 without losing $SF_6$ gas and without ingress of air.

In most cases circuit-breakers operate at fairly low voltages and are relatively compact, thereby enabling an entire circuit-breaker to be packaged without difficulty for transportation purposes.

However, very high tension circuit-breakers are very bulky and present packaging problems for transportation purposes. As a result, it is advantageous to be able to deliver such equipment in separate component parts which are factory-processed and inflated at low pressure, which can then be assembled on site without ingress of air into pressurized gas enclosures therein, and which can finally be raised to operating pressure without further steps, e.g. of gas purification. It is also advantageous to be able to insert the molecular sieve at the last moment on site, i.e. just before the circuit-breaking chamber is assembled onto its insulating support.

It is even more advantageous to be able to disassemble a circuit-breaking chamber from its support without spoiling the sealing of either enclosure, and then to be able to replace the molecular sieve, where necessary, while maintaining both enclosures properly sealed.

A circuit-breaker in accordance with the present invention satisfies these criteria.

SUMMARY OF THE INVENTION

The present invention provides a high-tension circuit-breaker having dielectric gas under pressure, the circuit-breaker comprising at least one assembled pair of first and second superposed insulating columns, the first column acting as a support and the second column enclosing a circuit-breaking chamber, each of said columns being provided at its end facing the other column of the pair with a closure plate enabling the columns to be disassembled without losing the gas contained in either of them, said plates being provided with respective central holes for passing a rod for operating the circuit-breaker contacts, the circuit-breaker including the improvement whereby each of said plates includes at least one hollow portion with said hollow portions facing each other in pairs, each of which defines a housing for receiving a container of regenerator material, the end of each hollow portion and the two ends of each container being provided with holes to enable gas to flow from one column to the other through said regenerator material, with the holes through said hollow portions being closed by valve plates located inside the columns and urged by springs towards a closure position when the columns are disassembled, with each of the valve plates including a part which, when the columns are assembled and a container is in place, bears against the container in order to hold the valve plate in its open position against the resilient urging of the spring.

BRIEF DESCRIPTION OF THE DRAWINGS

Embodiments of the invention are described by way of example with reference to the accompanying drawings, in which.

DESCRIPTION OF PREFERRED EMBODIMENTS

Figure 1:
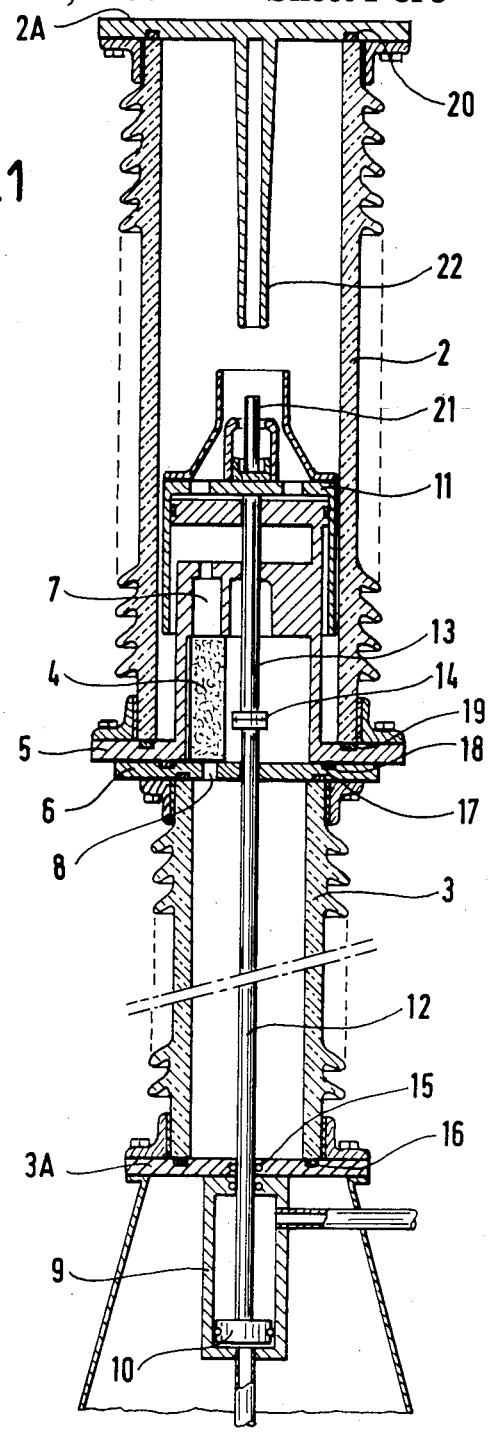
FIG. 1 is a fragmentary axial section through one pole of a prior art circuit-breaker including a regenerator element.

FIG. 1 is described above. Items which are common to both FIGS. 1 and 2 have the same reference numerals in each figure.

Figure 2:
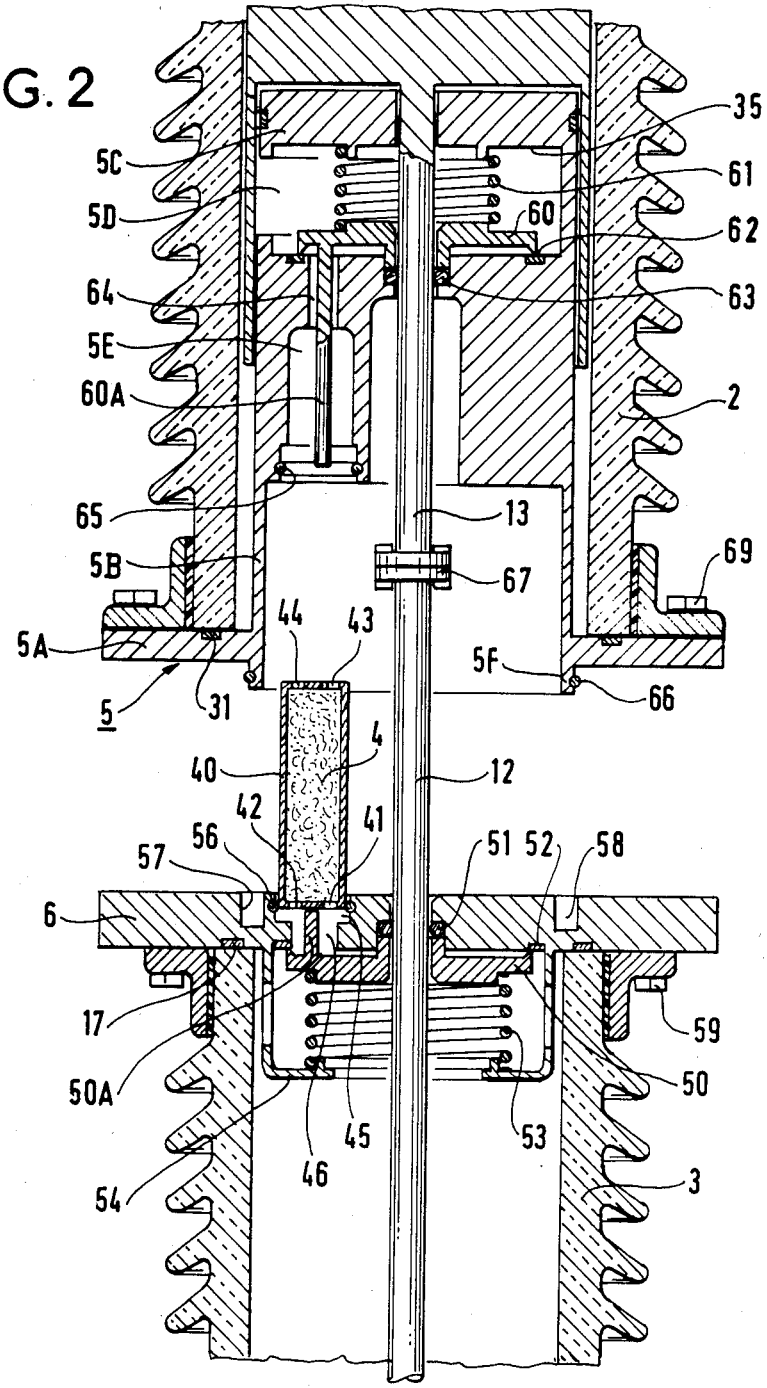
FIG. 2 is a fragmentary axial section through one pole of a circuit-breaker in accordance with the invention, shown in its disassembled position.
Figure 3:
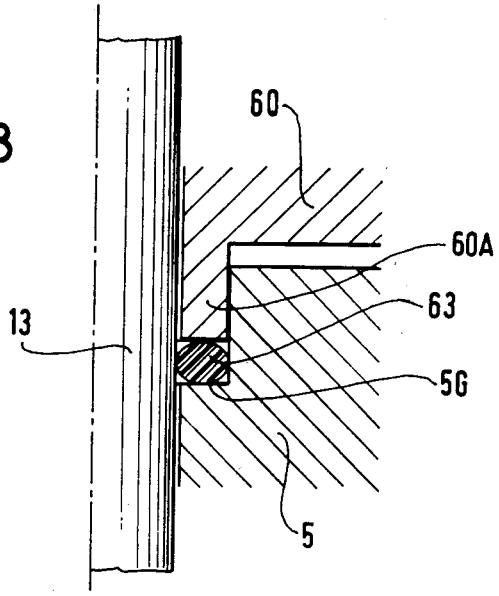
FIG. 3 shows a detail of FIG. 2 to a larger scale while the pole is in its disassembled position.

FIG. 2 is a fragmentary axial section through a circuit-breaker in accordance with the invention. The column 2 (circuit-breaking chamber) and the column 3 (its support) are shown disassembled.

In accordance with the invention, the molecular sieve 4 is disposed in a cylindrical container 40 whose end faces are provided with openings such as 41, 42, 43, and 44. The container is placed in a recess 45 in the top end plate 6 which closes the support column 3.

The recess 45 communicates via an opening 46 through the top end plate 6 with the inside of the column 3. The opening 46 is level with the opening 41 and 42 in order to allow gas to flow through the molecular sieve when the circuit-breaker is assembled.

The column 3 is sealed, when the circuit-breaker is disassembled, by means of a valve plate 50 which slides along the rod 12. A sealing ring 51 provides sealing between the rod 12 and the valve plate 50. A flat gasket 52 mounted on the end plate 6 co-operates with the valve plate in order to provide sealing between the inside and the outside of the support column 3.

To this end, the valve plate is urged by a spring 53 pressing against a fixed abutment 54 which is fixed to the end plate 6. The container 40 is in contact with a rod 50A which is integrally formed with the valve plate.

The function of this rod is explained below.

The recess 45 is fitted with a sealing ring 56 which co-operates with the container.

The circuit-breaking column 2 is likewise sealed, when the circuit-breaker is disassembled, by a valve plate 60.

This valve plate co-operates with the casing 5. The casing is a complex part having an outwardly-directed flange 5A at one end for pressing in sealed manner against the top end plate 6 of the support chamber 3, a cylindrical portion 5B serving as a housing for the molecular sieve, an end 5C constituting a blast piston, and a cavity 5D housing a valve plate actuating spring 61.

The valve plate presses against a flat gasket 62 disposed on a bearing surface in the cavity. Sealing between the rod 13 and the valve plate is provided by sealing ring 63.

The cavity 5D communicates with the outside via an opening 64 whose function is explained below.

The valve plate 60 has a rod 60A for coming into contact with the container when the circuit-breaker is assembled.

The casing 5 has a cavity 5E for receiving the top of the container. This cavity 5E is provided with a sealing ring 65.

Finally, the casing 5 has a bottom end skirt 5F provided with a sealing ring 66 for co-operating with a bearing surface 57 in a circular groove 58 provided in the top end plate 6.

Assembly and disassembly of the circuit-breaker is now described with reference to FIGS. 2 to 5.

In FIG. 2, the circuit-breaker is shown disassembled and in the process of being assembled. The column 2 filled with dielectric gas under pressure is closed in sealed manner, with the valve plate 60 being pressed against the gasket 62 by the spring 61.

The passage of the rod 31 is sealed by the sealing ring 63 which sealing ring is clamped between a skirt projecting from the valve plate 60 and a lip 5G projecting from the casing 5 (see FIG. 3) with the sealing ring being elastically deformable and pressed against the rod 13.

Similarly, the chamber 3 is closed in sealed manner by the valve plate 50 being pressed by the spring 53 against the gasket 52 and by the sealing ring 51 being pressed against the rod 12.

In order to assemble the columns, they are placed in vertical alignment as shown in FIG. 2 and the rods 12 and 13 are fastened together by bolts 67.

The molecular sieve container 40 is then placed in its recess 45.

The columns 2 and 3 are moved towards each other.

Figure 4:
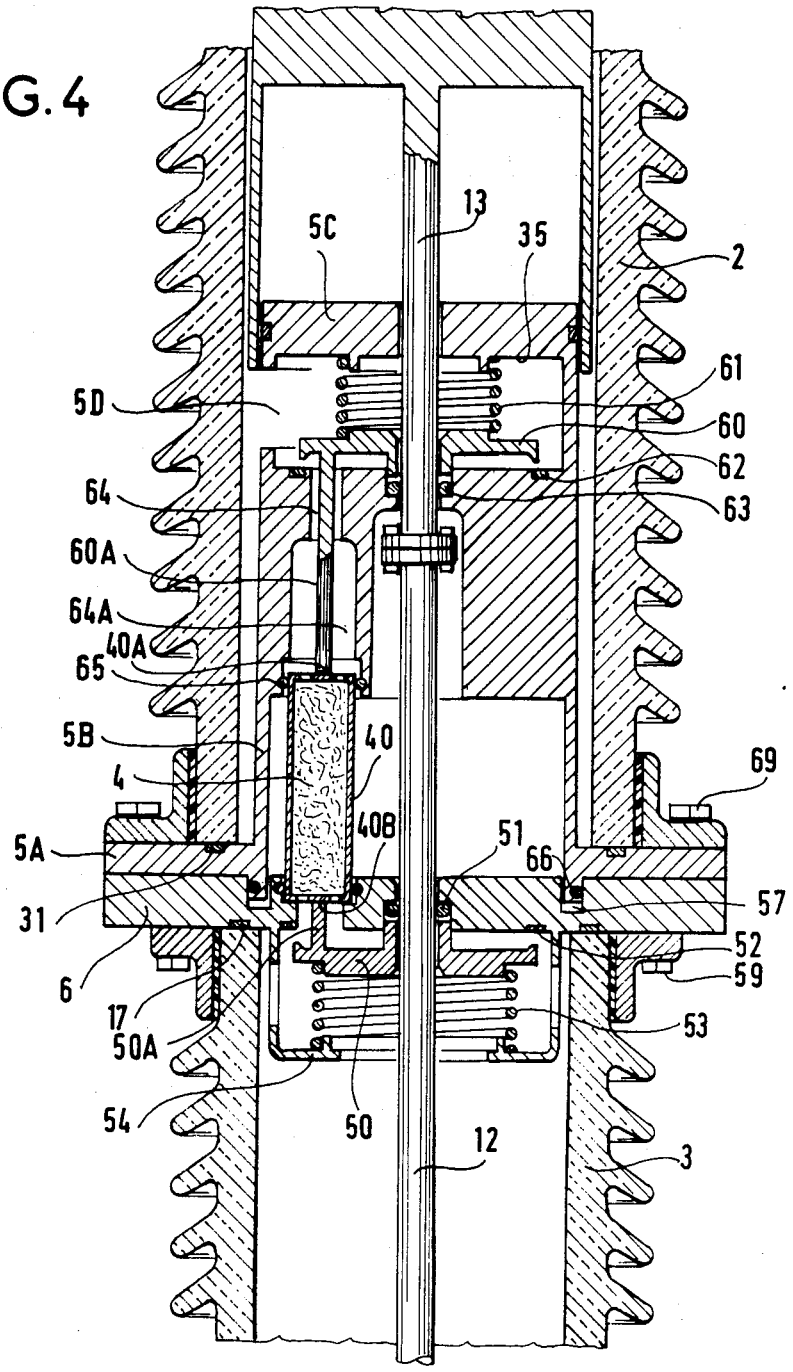
FIG. 4 shows the FIG. 2 pole in its assembled position.

FIG. 4 shows the final stage of the operation.

Before the casing 5 of the circuit-breaking chamber 2 has come into contact with the top plate 6 of the support chamber 3, the sealing ring 66 comes into contact with the bearing surface 57 in the groove in the top face of the top end plate 6, thereby sealing the two assembled columns.

Then, the rod 60A of the valve plate 60 pressing against the top bearing surface 40A of the container 40, and the rod 50A of the valve plate 50 pressing against the bottom portion 40B of the container 40 cause the valve plates 60 and 50 to move away from their respective gaskets 62 and 52 during the last few millimeters of the descent of the chamber 2.

Figure 5:
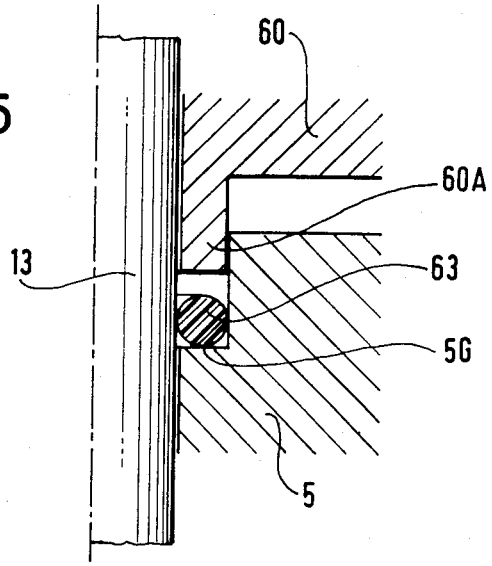
FIG. 5 shows the same detail as FIG. 3, but with the pole in its assembled position.

The sealing rings 51 and 63 are decompressed, thereby releasing the rods 12 and 13 respectively (see FIG. 5).

Compressed $SF_6$ gas can thus pass between the columns 2 and 3 via the molecular sieve 40 and via passages 41 to 44.

The sealing rings 55 and 65 around the container encourage the gas to flow through the sieve.

The assembly operation is terminated by tightening bolts 59 and 69.

The above description relates to an installation using a single regenerator element.

Figure 6:
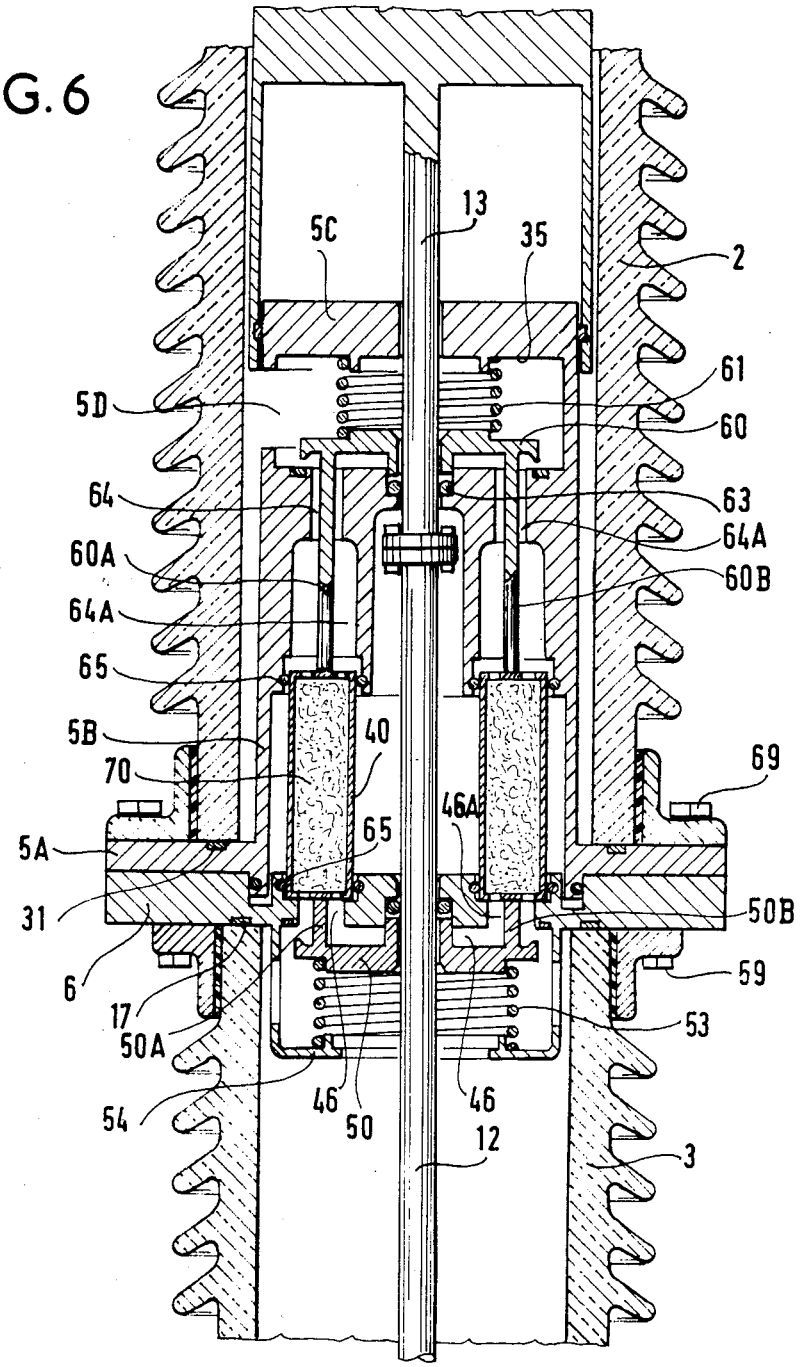
FIG. 6 is a fragmentary axial section through a variant circuit-breaker in accordance with the invention.

When the volume of the enclosures is very large (as for very high tension single interruption circuit-breakers) a single regenerator element is not enough, in which case two to six containers such as 70 may be placed inside the casing 5 of the circuit-breaking chamber 2, as shown in FIG. 6.

This is done by providing each of the valve plates with a corresponding number of uniformly distributed rods (such as 60A, 60B, 50A, 50B) together with corresponding passages (such as 64, 64A, 46, 46A) around the respective rods through the casing 5 of the chamber 2 and through the end plate 6 of the support 3.

I claim:

1. A high-tension circuit-breaker containing dielectric gas under pressure, the circuit-breaker comprising at least one assembled pair of first and second superposed insulating columns, the first column acting as a support and the second column enclosing a circuit-breaking chamber, wherein each of said columns is provided at its end facing the other column of the pair with a closure plate enabling the columns to be disassembled without losing the gas contained in either of them, said plates being provided with respective central holes for passing a rod for operating the circuit-breaker contacts, each of said plates including at least one hollow portion with said hollow portions facing each other in pairs, each of which pairs defines a housing for receiving a container of regenerator material for said dielectric gas, the end of each hollow portion and both ends of each container being provided with holes to enable gas to flow from one column to the other through said regenerator material, with the holes through said hollow portions being closed by valve plates located inside the columns and urged by springs towards a closure position when the columns are disassembled, with said valve plates including respective parts which, when the columns are assembled and a container is in place, bear against the container in order to hold the valve plates in their open positions against the resilient urging of the springs.

2. A circuit-breaker according to claim 1, wherein the hollow portions in the plates include sealing rings for co-operating with the container received therein in order to seal the circuit-breaker while the columns are being disassembled.

3. A circuit-breaker according to claim 1, wherein one of the closure plates includes an end skirt fitted with a sealing ring and suitable for engaging in a circular groove provided in the other end plate, thereby providing sealing the inside of the two columns when assembled from the outside.

4. A circuit-breaker according to claim 1, wherein each valve plate co-operates with a flat gasket provided on the corresponding end plate, and also with a sealing ring surrounding the operating rod.

* * * * *